United States Patent [19]

Leutner et al.

[11] 4,144,146

[45] Mar. 13, 1979

[54] CONTINUOUS MANUFACTURE OF SODIUM DITHIONITE SOLUTIONS BY CATHODIC REDUCTION

[75] Inventors: Bernd Leutner, Frankenthal; Gotthard Scizi, Bad Duerkheim; Siegmar Lukas; Siegfried Schreiner, both of Ludwigshafen; Erfried Voelkl, Frankenthal, all of Fed. Rep. of Germany

[73] Assignee: BASF Aktiengesellschaft, Rheinland, Pfalz, Fed. Rep. of Germany

[21] Appl. No.: 839,595

[22] Filed: Oct. 5, 1977

[30] Foreign Application Priority Data

Oct. 16, 1976 [DE] Fed. Rep. of Germany ..... 2646825

[51] Int. Cl.[2] ..... C25B 1/00

[52] U.S. Cl. ..... 204/92

[58] Field of Search ..... 204/92

[56] References Cited

U.S. PATENT DOCUMENTS

| | | | |
|---|---|---|---|
| 2,193,323 | 3/1940 | Nitzschke et al. | 204/92 |
| 3,920,551 | 11/1975 | Cook et al. | 204/92 |

FOREIGN PATENT DOCUMENTS

| | | | |
|---|---|---|---|
| 1045675 | 10/1966 | United Kingdom | 204/92 |

*Primary Examiner*—R. L. Andrews

*Attorney, Agent, or Firm*—Keil & Witherspoon

[57] ABSTRACT

Concentrated dithionite solutions are produced by cathodic reduction of an aqueous solution, containing sulfite and/or bisulfite, which is circulated by pumping. The cathode and anode chambers are separated from one another by a permselective cation exchanger membrane. The catholyte must be circulated at least 10 times per hour and the selective catholyte volume outside the cell, defined as $$a = V_{total} - V_C / V_{total},$$

should be less than 0.9.

6 Claims, 2 Drawing Figures

CONTINUOUS MANUFACTURE OF SODIUM DITHIONITE SOLUTIONS BY CATHODIC REDUCTION

Figure 1:
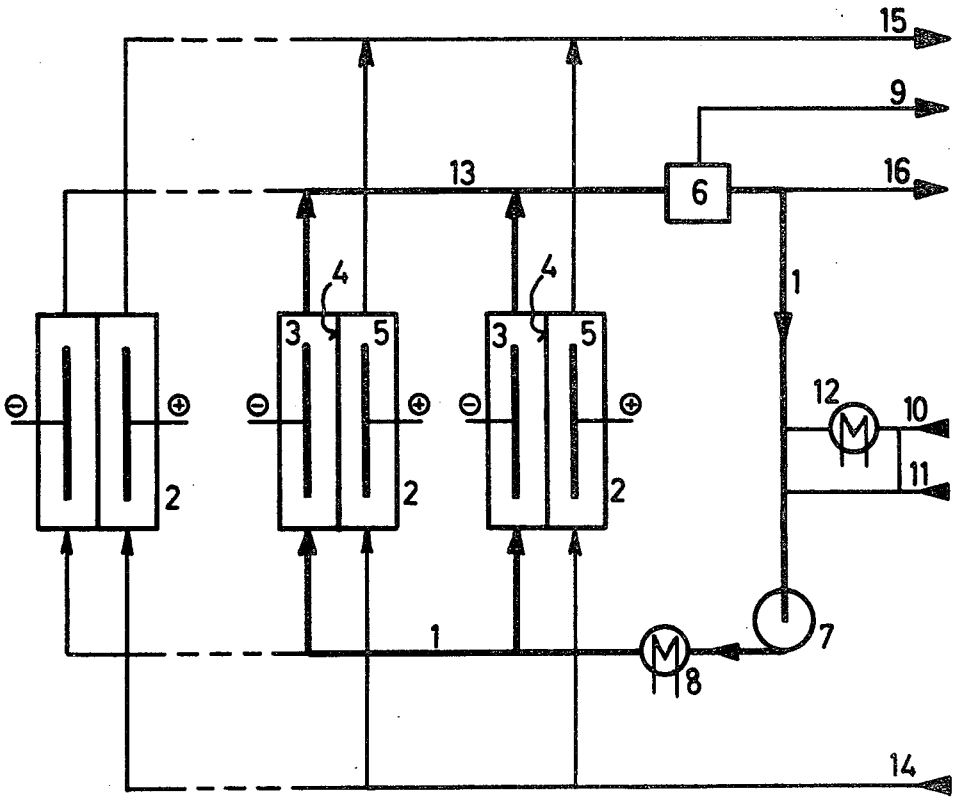

The present invention relates to an electrochemical process for the manufacture of concentrated dithionite solutions by cathodic direct reduction of solutions containing sulfite/bisulfite.

Because of their high reducing power, metal dithionites are extensively used industrially. A major field of use is in vat dyeing. Because of their high rate of autodecomposition and the instantaneous oxidation of aqueous metal dithionite solutions by atmospheric oxygen, these compounds are virtually only marketed as solids, mostly in the form of the relatively stable anhydrous sodium salt.

Solid sodium dithionite is manufactured from solutions of this salt, being isolated therefrom either by gentle evaporation under reduced pressure, by salting out by addition of readily water-soluble alkali metal salts, e.g. sodium chloride, or by precipitation by means of organic water-miscible solvents, e.g. tetrahydrofuran, ethanol, methanol or the like. Of course, concentrated dithionite solutions are exceptionally desirable if high precipitation yields are to be attained.

The sodium, potassium and zinc dithionites, which are the best-known salts of dithionous acid, $H_2S_2O_4$, which itself has hitherto never been isolated in the free state, are obtained in the form of their aqueous solutions exclusively by reduction of bisulfite solutions. The equation for the reaction can be represented, overall, by the general ionic equation:

$$2\,\overset{+4-}{HSO_3} + 2\,e^- \rightarrow \overset{+3--}{S_2O_4} + 2\,OH^-$$

The reducing agent used industrially is in most cases zinc dust, formic acid or sodium amalgam (Ullmann, Volume 15, 3rd edition, pages 482/3).

Although the electrochemical cathodic reduction of bisulfite is feasible and has been investigated extensively, it has attained virtually no industrial importance. There are various reasons for this, especially the fact that in the electrolytic preparation of dithionite solutions the yield is found to decrease greatly with increasing dithionite concentration. On the other hand, as mentioned above, it is a precondition of low-loss conversion to the solid salt that the solution should be as concentrated as possible. This disadvantage manifests itself above all when attempts are made to carry out the electrolysis for sustained periods, which is a further essential precondition for the industrial use of the process.

A plurality of proposals for improving the process for the manufacture of dithionites by cathodic reduction of solutions containing sulfite/bisulfite has been disclosed. These proposals essentially relate to the conditions to be maintained in the actual electrolysis cell, e.g. the temperature, the pH, current density relative to the surface of the cathode and turbulence of the catholyte (U.S. Pat. No. 2,193,323). Initially, diaphragms were used as the partition between the catholyte and the anolyte. British Pat. No. 1,045,675 proposes replacing the diaphragm by a porous partition which is selectively permeable to the dithionite cation to be formed, and consists of a strongly acid cation exchanger material. According to the Example of the said British Patent, the process can also be carried out continuously, but the total duration does not exceed 2 hours. The volume of the catholyte chamber is given as 50 $cm^3$ and the volume of the total catholyte circulation system as 150 $cm^3$, the catholyte being circulated at a rate of 0.7 l per hour. This means that the catholyte is circulated from about four to five times per hour.

U.S. Pat. No. 3,920,551 discloses a process for the electrolytic preparation of dithionites which also employs permselective membranes; these consist of hydrolyzed copolymers of perfluorinated hydrocarbons and a fluorosulfonated perfluorovinyl ether. The process can also be carried out continuously, in which case the unit for carrying out the process consists of a cell and a recirculation loop which includes a storage tank into which the sulfur dioxide and water to make up for material consumed can be introduced. The volume of this external circulation system may be from 2 to 100,000 times the volume of the cathode compartment. A disadvantage of this process is that in continuous operation the solution obtained contain at most 100 g of dithionite/l.

It is an object of the present invention to provide a process for the continuous manufacture of concentrated, aqueous dithionite solutions by cathodic reduction of an aqueous circulated solution containing sulfite and/or bisulfite in the cathode chamber of an electrolysis cell, which cell comprises a cathode chamber with a cathode and an anode chamber with an anode, the chambers being separated by a cation exchanger membrane which is permselective toward the dithionite counter-ion.

We have found that this object is achieved by a method wherein the solution is circulated at least 10 times per hour, with the proviso that the relative catholyte volume outside the cell, defined as $a = V_{total} - V_C / V_{total}$, wherein $V_{total}$ is the total catholyte volume and $V_C$ is the volume of the catholyte in the cathode chamber, is less than 0.9.

The present invention is based on the surprising discovery that in a process for the manufacture of dithionites by cathodic reduction of circulated solutions containing sulfite and/or bisulfite it is not only the conditions to be maintained in the actual cell which are critical, in particular for achieving high concentrations, but also the total catholyte volume and the rate of circulation of the catholyte through the entire circulation system.

The catholyte chamber volume is defined as the volume of the cathode chamber within the cell space, whilst the total catholyte volume in addition includes the volume of the catholyte in the circulation system which essentially comprises the heat exchanger, circulating pump, calming chamber and the pipes connecting the same.

According to the invention, the maximum relative catholyte volume outside the cell should not exceed a value of 0.9, preferably a value of 0.66. This means, in other words, that the catholyte volume outside the cell is at most 9 times, and preferably at most twice, the volume of the catholyte in the cathode chamber.

The factor of decisive importance is that the catholyte is circulated at least 10 times, and preferably from about 100 to 600 times, per hour. For technical and energy reasons, a figure of 1,000 should as a rule not be exceeded.

The process can be carried out in monocells, but particularly advantageously in a cell block of up to 100 individual cells, arranged in series, with bipolar electrodes. In that case, both the catholyte and the anolyte are fed into and withdrawn from the individual cell chambers in parallel. Of course, in that case the volume of the catholyte in the cathode chamber is the sum of that of the individual chambers, so that a is given by:

$$a = V_{total} - n \cdot V_C / V_{total}$$

where n is the number of cells. If cells with bipolar electrodes, assembled in the manner of a filterpress, are used, the arrangement has the advantage that the value of the relative catholyte volume a can be kept particularly low and that figures of, for example, from 0.9 to about 0.2 are achievable.

The process according to the invention is explained in more detail with the aid of the schematic representation in FIG. 1.

The catholyte is fed from line 1 to the cathode chambers 3 of the individual electrolysis cells 2. The cathode chambers 3 and anode chambers 5 are separated from one another by permselective cation exchanger membranes 4. The streams of catholyte issuing from the cathode chambers 3 are combined in line 13 and pass into a degassing vessel 6 to remove any hydrogen gas bubbles which have formed, the hydrogen being discharged at 9. The circulation is maintained by the pump 7. The catholyte is kept at the desired operating temperature in the heat exchanger 8. The catholyte can of course also be cooled within the cell, for example by using cooled cathodes or by evaporative cooling, for example by admixture of a low-boiling organic compound, e.g. a chlorofluorocarbon, to the electrolyte.

A sulfite solution, in which the cation corresponds to that of the dithionite to be prepared, e.g. sodium sulfite, potassium sulfite or zinc bisulfite, is fed through line 10 into the catholyte circulation solution; this feed may or may not pass through a heat exchanger 12 which brings it to the operating temperature. Sulfur dioxide may be fed into the catholyte through line 11. If the sulfite solution has beforehand been saturated with $SO_2$, the heat of solution can be removed in a heat exchanger 12, which has the advantage that cooling is effected at a higher temperature level and hence the heat exchange surface is smaller than in the catholyte circulation.

An amount of catholyte solution which approximately corresponds to the added volume of sulfite solution is taken off through line 16 and solid sodium dithionite is isolated therefrom by partial evaporation under reduced pressure, by adding solid sodium chloride, by cooling or by adding water-miscible organic solvents, e.g. methanol; the precipitation yield is from about 60% to about 90%.

Using a similar method to that described for the catholyte, anolyte is fed, through the manifold 14, into the anode chambers of the cells 2, and the depleted anolyte is collectively removed through line 15.

If alkali metal chloride solutions are used as the anolyte, the solution issuing from the anode chambers is passed through a chlorine degassing vessel located above the cells and not shown in the Figure. In this vessel, the depleted liquor is at the same time resaturated, for example by heaving a constant supply of solid alkali metal chloride at the bottom of the vessel. From the degassing vessel, the reconcentrated liquid flows back through a cooler into the anode chambers. As a result of the air-lift pump effect of the chlorine bubbles within the cell chambers, it may not be necessary to fit a liquor circulating pump.

In the case of alkali metal dithionites, the catholyte employed is advantageously a solution which has a pH of from 4.5 to 6.5, preferably from 4.8 to 6.0, and contains from 0.2 to 1.3 moles of $HSO^-_3$/l, from 0.055 to 0.55 mole of $SO_3^{--}$/l and not less than 0.6 mole of $S_2O_4^{--}$/l. For the preparation of zinc dithionite, the pH is advantageously kept at a more acid value of from 2.0 to 4.5, with concentrations of from 0.2 to 1.5 moles of $HSO_3^{31}$ /l and not less than 0.5 mole of $S_2O_4^{--}$/l. Because of the low solubility of zinc sulfite, the concentration of $SO_3^{--}$ is negligibly low. In each case, the catholyte is at from about 15° to 40° C.

To achieve maximum $S_2O_4^{--}$ concentrations, the flow rate over the cathode surface should be not less than 1 cm/s, preferably from 2 to 10 cm/s. This flow rate is calculated from the equation $C = V/F$, where V is the throughput of catholyte in $cm^3/s$ and $F = d \cdot l$, i.e. the area obtained by multiplying the cathode gap width by the cathode width, each in cm units.

A further important factor in achieving a good current efficiency for dithionite formation and achieving a high dithionite concentration is that the current concentration should be as high as possible. This is defined as the quotient of the total current intensity and the total catholyte volume, $I/V_{total}$. With n bipolar electrolysis cells, through which the same circulating catholyte, having a total volume $V_{total}$, flows, the current concentration is then of course $n \cdot I/V_{total}$, where I is the current intensity applied to the bipolar cell packet. The current concentration should be at least 40 A/l, preferably 60 - 250 A/l.

The construction of the cathode is also a critical factor in achieving a maximum dithionite concentration. It is particularly advantageous to employ nets or fibrous mats formed by compressing or sintering fibers, the filaments of such nets or mats having a thickness of from about 0.005 to 3 mm and the mesh spacing of nets being from about 0.05 to 5 mm. Of course, a random mass of particles of the stated dimensions can also be used as the cathode.

The cathode material must be electrically conductive and must be able to withstand the corrosive character of the bisulfite-containing catholyte. Noble metals and electrically conductive noble metal oxides from group 8 of the periodic table (i.e. ruthenium, rhodium, palladium, osmium, iridium and platinum), as well as silver, chromium and stainless (Fe/Cr/Ni) steels, especially steels containing 2% or more of molybdenum, have proved suitable. The Mo content greatly represses pitting corrosion. Titanium, tantalum and their alloys can also be employed successfully. It is also possible to employ less resistant metals or alloys provided these carry a dense, corrosion-resistant coating of the stated materials, examples being silvered copper or copper alloys, or nickel-plated iron.

The cation exchanger membrane which is permselective toward the positive counter-ion of the dithionite must be sufficiently stable to the reducing catholyte and to the anolyte. If, for example, sodium hydroxide solution, sodium sulfite solution or sodium sulfate is used as the anolyte in the manufacture of sodium dithionite, or the corresponding potassium compounds are used in the manufacture of potassium dithionite, or zinc sulfite or zinc sulfate are used for the manufacture of zinc dithionite, it suffices to employ a relatively cheap cation exchanger material based on crosslinked polystyrenes containing carboxylic acid groups or sulfonic acid groups. If, on the other hand, a chloride solution (e.g.

NaCl, KCl or $ZnCl_2$) is used as the anolyte, a cation exchanger material which is chemically resistant to chlorine must be employed because of the chlorine evolved at the anode. In such a case, polymeric perfluorinated hydrocarbons which carry carboxylic acid radicals or sulfonic acid radicals as cation exchanger groups are preferred, examples being copolymers of tetrafluoroethylene and a perfluorovinyl ether-sulfonic acid fluoride, e.g. perfluoro-(3,6-dioxy-4-methyl-7-octenesulfonyl fluoride, $CF_2 = CFOCF_2CF(CF_3)OCF_2CF_2SO_2F$, which are thermoplastically processable. After molding, for example to give a film, the sulfonyl fluoride groups of this copolymer are hydrolyzed with alkali. As a rule, such a membrane is mechanically reinforced by lamination with a fabric of polytetrafluoroethylene or some similar chlorine-resistant material (U.S. Pat. No. 3,282,875).

These membranes can be modified further, particularly to increase the permselectivity, either by providing sulfonic acid amide groups on the surface of one side of the membrane or by using a bilaminar film comprising a layer containing $—SO_3H$ groups and a layer containing $—SO_2NR_2$ groups (where R is H or alkyl) (U.S. Pat. Nos. 3,770,567 and 3,784,399 which are hereby incorporated by reference). Bilaminar and multilaminar films of materials having different exchange capacities have also been disclosed and are very suitable for the dithionite electrolysis. Other ion exchanger membranes which may be used are graft polymers based on perfluorohydrocarbons, onto which radicals containing sulfonic acid groups or carboxylic acid groups are grafted. Examples are membranes consisting of a perfluorinated ethylene/propylene copolymer onto which styrene has been grafted by means of $\gamma$-radiation, the ion exchanger end product being obtained by conventional sulfonation of the phenyl groups.

However, it is self-evident to those skilled in the art that any other cation exchanger may be employed as the membrane for a dithionite cell provided such an exchanger has proved adequate for use in chlorine/alkali membrane cells at 20° C. or above.

The anode used is advantageously a dimensionally stable anode of conventional type. If the anolyte consists of a solution containing chloride, the chlorine-resistant noble metals, especially those of sub-group VIII of the periodic table their alloys or oxides may be used for the dimensionally stable anodes; alternatively and, from the point of view of cost, preferably, so-called valve metals, e.g. titanium, tantalum or zirconium, which are surface-coated with noble metals of sub-group VIII of the periodic table, or their oxides, or mixtures of these oxides with valve metal oxides, may be used for the dimensionally stable anodes. In the presence of chloride ions, a particularly suitable anode has proved to be an expanded titanium metal which is surface-activated, on the side facing away from the mebrane, with a mixture of ruthenium oxide and titanium oxides.

It has proved particularly advantageous to regulate the pH of the catholyte by introducing liquid sulfur dioxide. If this is used, the supply tank and feed pipes can be kept particularly small and hence cheap. Furthermore, due to the heat of vaporization of the liquid $SO_2$, the exothermic effect observed is less than when gaseous sulfur dioxide is fed in, and as a result the cooling capacity required for cooling the catholyte is less.

The electrolysis cell is constructed as a two-compartment cell with the cation exchanger membrane as the partition between the anode and cathode chambers.

Both the anolyte and the catholyte are advantageously introduced at the bottom of the cell and are removed at the top of the cell together with the gases formed at the electrode, e.g. oxygen or chlorine at the anode and hydrogen at the cathode. A downward or side-to-side flow of electrolyte in the electrolysis cell is also feasible but less advisable because this provides less advantageous conditions for removing the gases formed in the reaction.

Using the process according to the invention it is possible, in sustained operation over several months, to obtain dithionite solutions of surprisingly high concentrations, close to the saturation limit. e.g. concentrations of 150–170 g of $Na_2S_2O_4$/l, with current efficiencies of from 65% to 90%.

EXAMPLE 1

A bipolar filter press cell with 7 individual cells arranged electrically in series is employed for the direct electrolytic manufacture of a sodium dithionite solution.

Each of these individual cells is divided into two compartments by a chlorine-resistant cation exchanger membrane consisting of a copolymer of tetrafluoroethylene and a perfluorovinylsulfonic acid containing ether groups. In the present Example, the membrane is reinforced with a polytetrafluoroethylene mesh fabric. It is 125 $\mu$m thick and has a so-called equivalent weight of 1,200, i.e. there is one sulfonic acid group per polymer molecular weight of 1,200. The dimensionally stable anode rests directly on the membrane and consists of an expanded titanium metal grid which has beforehand been doomed and welded onto a titanium plate (see FIG. 2). The Ti grid is activated with ruthenium oxide on the side facing away from the membrane.

Figure 2:
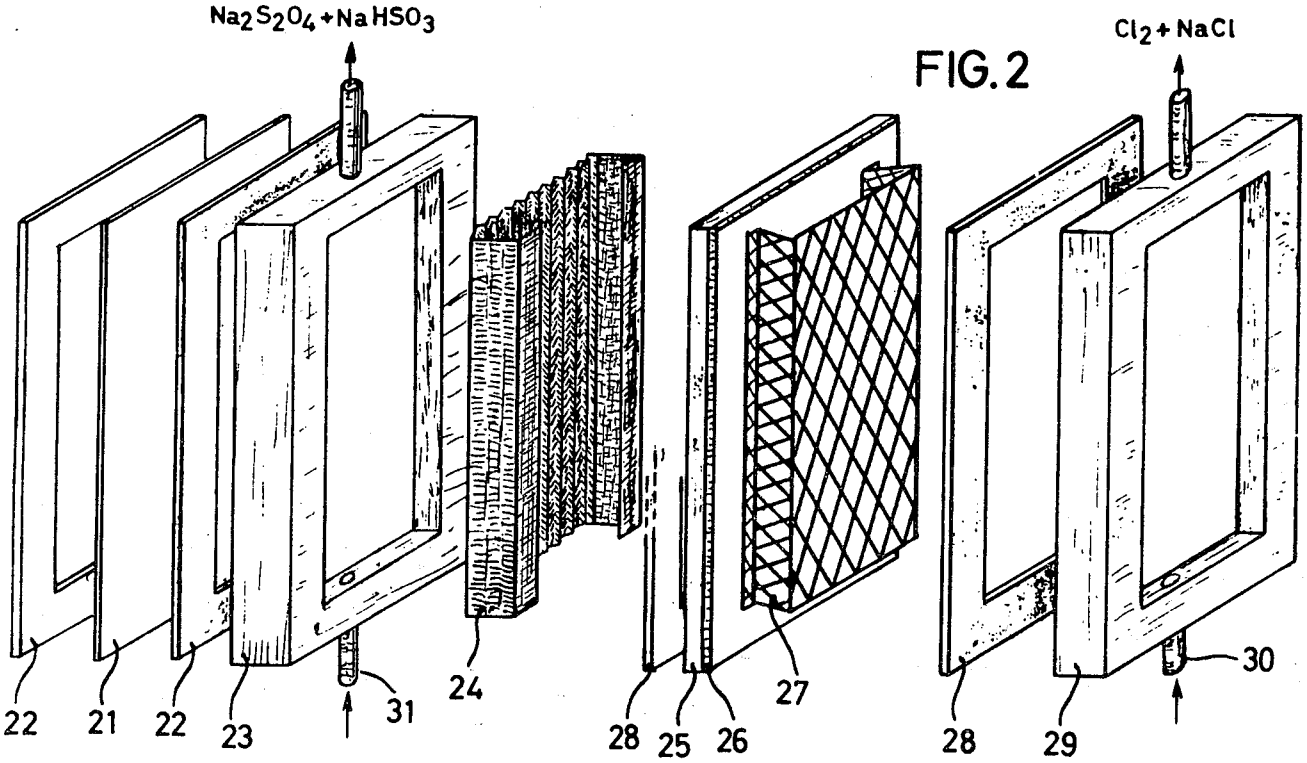

FIG. 2 shows the parts of a cell. 21 is the membrane, 22 and 28 are rubber gaskets, 23 and 29 are the cell frame and 24 is the cathode, consisting of a stainless steel net, which is conductively fixed to a plate 25 of the same material. On the anode side, this plate is covered with a 1–2 mm thick titanium sheet 26, for example by explosion plating. The anode 27 of titanium net is also electrically conductively fixed to the titanium sheet 26 and surface-activated. Anolyte solution is fed in through 30 and catholyte solution through 31.

The cathode consists of a fine sieve fabric of liner-weave Mo-containing stainless steel (material No. 1.4401 = AISI 316) having a mesh width of 0.315 mm, the wire being 0.2 mm thick. To increase the surface area, the net possesses a scrubber-board corrugation, the amplitude height (i.e. the height of the net) being 3 mm, and the valley-to-valley spacing being 9 mm. The electrolyte flows onto the net parallel to the corrugation and on sliding the various cell frames together the net is pressed against the membrane. All that remains between the membrane and the cathode net is a 2 mm thick extruded wide-mesh plastic grid which exhibits a very low resistance to flow in the direction of flow. The narrow edges of the corrugated net are bent over twice at right angles and the last bent-over portions are welded to a plate also made of stainless steel. A plastic sheet is pushed into the space between the cathode net and the steel plate in order to support the corrugated net and partially to fill the volume of the cathode chamber. The electrical connection to the adjacent cell is provided by simply pressing the cleaned rear face of the cathode plate against the cleaned rear face of the titanium plate of the anode of the adjacent cell. FIG. 2 shows a more expensive type of electrical contact which can also be employed. In this case, the stainless steel plate is connected to the titanium plate by explosion plating. We have not found any substantial differences between the two methods of making electrical contact.

The total volume of the catholyte in the 7 cathode chambers is 1.8 l and the total catholyte volume is 4.5 l, from which the relative catholyte volume a outside the cell is calculated to be $a = 4.5-1.8/4.5 = 0.6$. Per hour, 1.4 $m^3$ of catholyte are circulated, corresponding to 300 changes. Per minute, 20±1 ml of a solution of 66 g of sodium sulfite/liter are fed into the catholyte circulation and at the same time sufficient $SO_2$ (about 500 l/h) is passed in to give a constant pH of the catholyte of 4.6, as measured by means of a glass electrode.

Using a 7-cell block with an applied voltage of 39–45 V and a current intensity of 65 A, corresponding to 1.8 $kA/m^2$, at an operating temperature of 34° C., a catholyte solution which has a constant composition of 150 g of $Na_2S_2O_4$/l, 73 g of $NaHSO_3$/l and 20–22 g of $Na_2SO_3$/l is obtained after one hour's operation. The precondition for achieving equilibrium in such a short time is to use a starting solution containing 150 g of $Na_2S_2O_4$/l, 66 g of $Na_2SO_3$/l and 15 g of $Na_2S_2O_3$/l. After 3 hours, the catholyte is free from extremely fine $H_2$ gas bubbles, transparent, clear and slightly yellowish. The amount of catholyte issuing from the overflow and degassing vessel is 7.40 l/h, from which the current efficiency is calculated to be 75%.

The ratio of total current intensity to total catholyte volume is 100 A/l. The flow rate at the cathode surface is calculated, from the amount circulated per hour and the dimensions of the cathode chamber, to be 5.7 cm/s.

EXAMPLE 2

The electrolysis is carried out with the same cell arrangement and under the same operating conditions as in Example 1 except for the following changes: catholyte temperature 21° C., current intensity 35 A, voltage 35 V, pH = 5.2, sulfite feed 3.1 l/h. After 3 hours' operation, a clear solution is obtained, and after 5 hours its composition remains constant at 160 g of $Na_2S_2O_4$/l, 78 g of $NaHSO_3$/l and 13 – 18 g of $Na_2SO_3$/l. The current efficiency is calculated to be 81.8%, from the dithionite content and the amount of catholyte issuing from the cell, after equilibrium has been reached.

EXAMPLE 3

Instead of the stainless steel net cathode, a silver wool cathode is employed.

A bipolar arrangement with 3 electrolysis cells is utilized. Apart from the cathode, the cell assembly corresponds to that used in Example 1.

The cathode is silver wool, of which 100 g is uniformly spread flat over a surface of 140 × 260 mm and held together by means of a polypropylene grid. The total catholyte volume is 3.0 l and the catholyte chamber volume is 0.8 l, corresponding to a relative catholyte volume a of 0.73. The catholyte is circulated 400 times per hour. The operating parameters are:

| | T | I | i | U | pH | $NaHSO_3$ | $Na_2SO_3$ | $Na_2S_2O_4$ | $Na_2SO_3$ feed |
|---|---|---|---|---|---|---|---|---|---|
| 1. | 32° | 85 A | 2.3 $kA/m^2$ | 23 V | 4.8 | 90–92 g/l | 7–9 g/l | 150 g/l | 51.1 ml/h |
| 2. | 25° | 85 A | 2.3 " | 28 V | 4.8 | 90–92 g/l | 7–9 g/l | 180 g/l | 51.1 ml/h |

The resulting current efficiency is 74% at 32° C. and 82% at 25° C.

EXAMPLE 4

Instead of the 3 silver wool cathodes from Example 3, 2 mm thick mats of 65 μm thick sintered stainless steel filaments (material No. 1.4404) are used. With the following operating paramaters

| T | I | i | U | pH | $NaHSO_3$ | $Na_2SO_3$ | $Na_2SO_3$ feed |
|---|---|---|---|---|---|---|---|
| 25° | 85 A | 2.3 $kA/cm^2$ | 2.8 V | 4.8 | 90 g/l | 7–9 g/l | 3.1 l/h |

a concentrated dithionite solution containing 155 g of $Na_2S_2O_4$/l is obtained and after 5 hours the current efficiency remains constant at 80.5%. The mat has a density of 1.6 and a porosity of 80%.

EXAMPLE 5

A concentrated potassium dithionite solution is produced continuously using the same cell arrangement and - except where stated otherwise - the same operating conditions as in Example 1. The anolyte employed is a saturated KCl solution, whilst a solution of 117 g of $K_2S_2O_5$/l is employed for the catholyte feed.

With the following operating parameters

| T | I | i | U | pH | $KHSO_3$ | $K_2SO_3$ |
|---|---|---|---|---|---|---|
| 26° | 65 A | 1.8 $kA/m^2$ | 43–45 V | 5.8 | 93 g/l | 15 g/l |

a solution containing 160 g of $K_2S_2O_4$/l is obtained, with a current efficiency of 70%.

Because of the high solubility of potassium dithionite it is even possible to take a catholyte containing more than 200 g of $K_2S_2O_4$/l from the cell chambers in continuous operation.

EXAMPLE 6

Using the same cell arrangement as in Example 1, a zinc dithionite solution is prepared continuously. The anolyte consists of a 25% strength by weight $ZnCl_2$ solution. A solution of 30 g of $Zn(HSO_3)_2$/l is fed into the catholyte circulation.

The operating parameters are:

| T | I | i | U | pH | $Zn(HSO_3)_2$ |
|---|---|---|---|---|---|
| 30° | 40 A | 1.25 $kA/m^2$ | 23–25 V | 2.6–2.7 | 180–185 g/l |

From the volume of catholyte which issues, and the equilibrium concentration of 119 g of $ZnS_2O_4$/l in the catholyte, the current efficiency is calculated to be 53%.

We claim:

1. In a process for the continuous manufacture of concentrated dithionite solutions by cathodic reduction of an aqueous circulated solution containing sulfite and/or bisulfite in the cathode chamber of an electrolysis cell, which cell comprises a cathode chamber with a cathode and an anode chamber with an anode, the chambers being separated by a cation exchanger membrane which is permselective towards the dithionite counter-ion wherein the improvement comprises: recirculating the solution at least 10 times per hour, with the proviso that the relative catholyte volume outside the cell, defined as $a = V_{total} - V_C / V_{total}$ wherein $V_{total}$ is the total catholyte volume and $V_C$ is the volume of the catholyte in the cathode chamber, is less than 0.9.

2. A process as set forth in claim 1, wherein the relative catholyte volume a outside the cell is less than 0.66.

3. A process as set forth in claim 1, wherein the catholyte is circulated at least 30 times per hour.

4. A process as set forth in claim 1, wherein, when using alkali metal dithionites as the catholyte, a solution containing from 0.2 to 1.3 moles of $HSO_3^-$/l, from 0.055 to 0.55 mole of $SO_3^{--}$/l and not less than 0.6 mole of $S_2O_4^{--}$/l is employed at a pH of from 4.5 to 6.5.

5. A process as set forth in claim 1, wherein the catholyte is passed over the cathode surface at a speed greater than 1 cm/sec.

6. A process as set forth in claim 1, wherein the catholyte temperature is from 15° to 40° C.

* * * * *